United States Patent [19]

Hanson

[11] 4,234,981

[45] Nov. 25, 1980

[54] MATTRESS FOR ARTICULATED BEDS

[76] Inventor: Paul B. Hanson, 2761 Eastwood Dr., Decatur, Ga. 31907

[21] Appl. No.: 954,902

[22] Filed: Oct. 26, 1978

[51] Int. Cl.[2] ..... A47C 3/32

[52] U.S. Cl. ..... 5/411; 5/448; 5/465; 5/475

[58] Field of Search ..... 5/248, 256, 259 R, 260, 5/267, 411, 412, 448, 467, 474, 480, 486, 505, 475

[56] References Cited

U.S. PATENT DOCUMENTS

| | | | |
|---|---|---|---|
| 3,151,344 | 10/1964 | Okura | 5/260 |
| 3,242,505 | 3/1966 | Tyhanic | 5/260 |
| 3,256,535 | 3/1966 | Anson | 5/248 |
| 3,334,951 | 8/1967 | Douglass, Jr. et al. | 5/90 |
| 3,959,833 | 6/1976 | Burke | 5/90 |
| 3,991,428 | 11/1976 | Hanson | 5/63 |
| 4,086,673 | 5/1978 | Hanson | 5/411 |
| 4,122,567 | 10/1978 | Hanson | 5/448 |

*Primary Examiner*—Casmir A. Nunberg

*Attorney, Agent, or Firm*—Newton, Hopkins & Ormsby

[57] ABSTRACT

A unitary inner spring or elastomer bed mattress is provided at its median plane with a wire reinforcing grid of selected rigidity. The grid spans substantially the entire area of the mattress in terms of its major surfaces. A marginal frame for the mattress can be employed in conjunction with the grid and the mattress may have a recess in one end thereof. The necessity for a separate box spring beneath the mattress is avoided.

22 Claims, 13 Drawing Figures

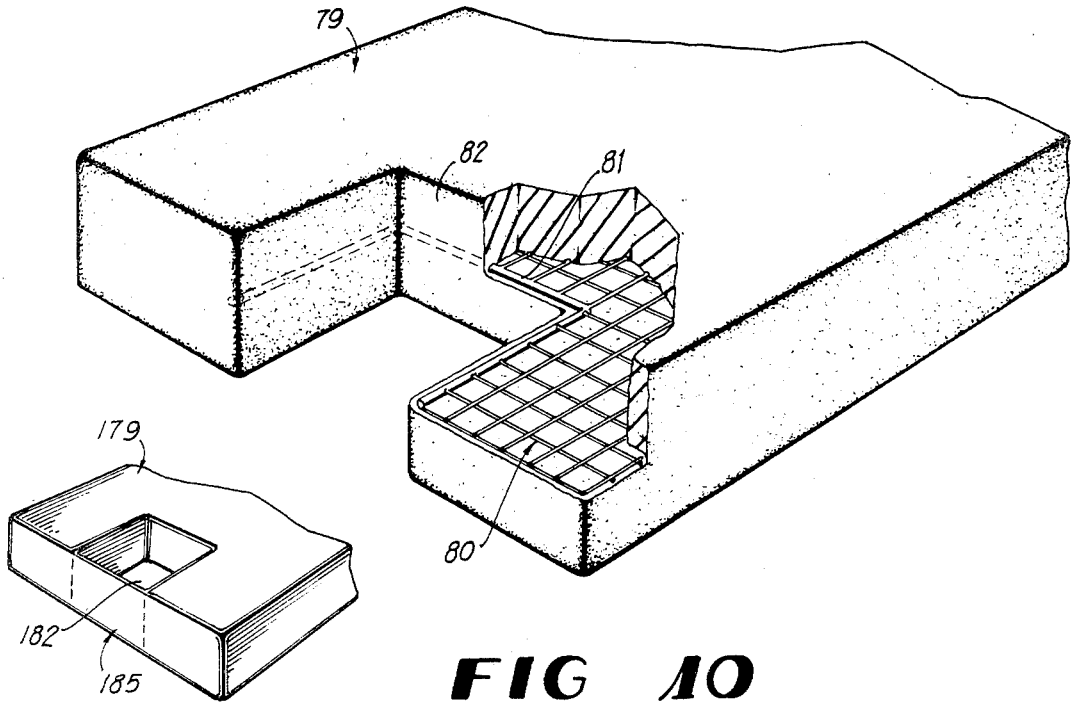
FIG 10
FIG 12
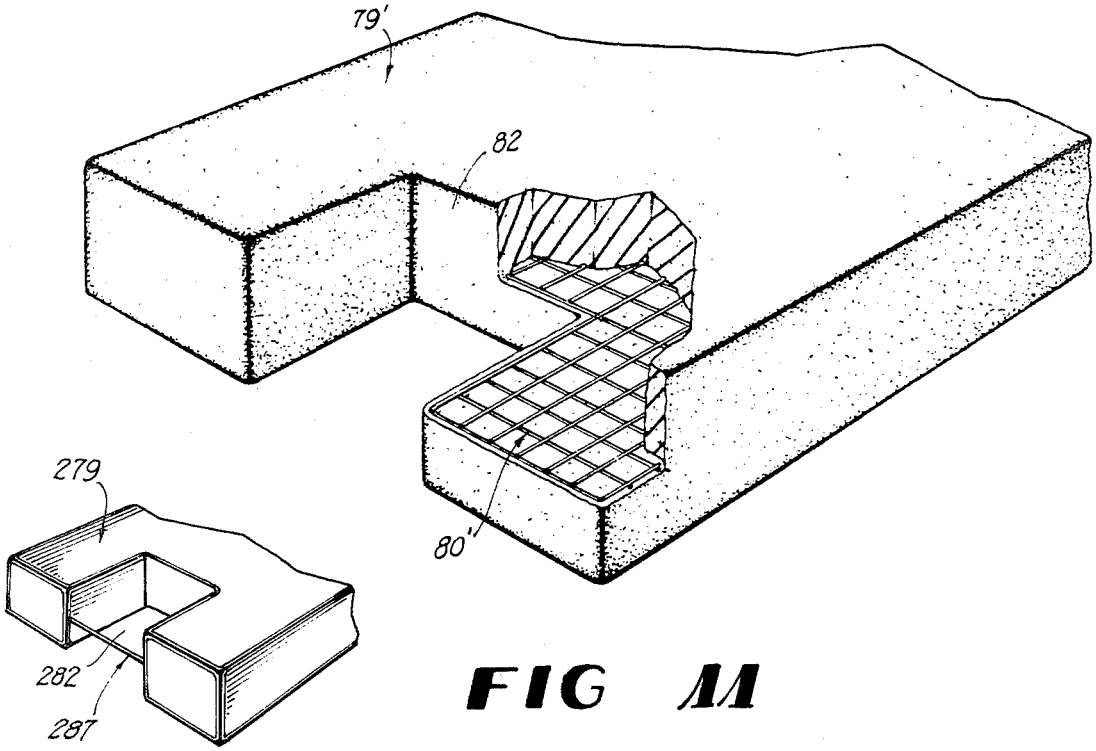
FIG 11
FIG 13

MATTRESS FOR ARTICULATED BEDS

CROSS-REFERENCE TO RELATED APPLICATIONS

This application contains common subject matter with prior copending applications Ser. No. 702,022, filed July 2, 1976 now U.S. Pat. No. 3,876,077 for ARTICULATED BED, and Ser. No. 710,597, filed Aug. 2, 1976 now U.S. Pat. No. 4,122,567 for IMPROVED ARTICULATED BED.

BACKGROUND OF THE INVENTION

The present invention seeks to provide an improved bed mattress of greater durability and shape retention than those known in the prior art. The invention is embodied in a high profile unitary mattress which can be used without an underlying box spring unit and which possesses an internal reinforcing wire grid of selected rigidity to prevent sagging and other permanent deformation of the mattress caused by usage.

In one embodiment, the wire grid which is preferably located at the median plane of the high profile mattress is employed in conjunction with opposite side multiple coil springs and a marginal wire reinforcing main frame, all of these elements being disposed internally of the mattress casing.

In another embodiment, the reinforcing median plane wire grid can be embedded bodily in a mattress formed of foam rubber or other elastomeric material.

Both forms of mattress can be provided with a recess in one end thereof with a partially or completely framed recess of the type disclosed in certain prior art articulated beds which facilitate sexual intercourse. The reinforcing grid and associated coil springs and mattress marginal frame may also be used in mattresses which do not possess the aforementioned recess.

To comply with the duty to disclose under 37 C.F.R. 1.56, the following known prior art U.S. patents are hereby made of record: Nos.

1,347,666
2,462,579
2,767,410
1,372,802
3,855,652
1,274,851
3,991,428.

The general objective of the invention is to improve on the prior art in terms of the features enumerated above. More particularly, it is an object of the invention to improve on that class of mattress disclosed in the above-referenced patent applications and in U.S. Pat. No. 3,991,428.

Specific features and advantages of the invention will become more apparent during the course of the following detailed description.

BRIEF DESCRIPTION OF THE DRAWINGS

FIG. 10 is a fragmentary perspective view, partly in cross section, showing a modification of the invention embodied in an elastomer mattress.

FIG. 11 is a perspective view, similar to FIG. 10, showing a variant of the invention. FIG. 12 is a perspective view showing a modification of the mattress in FIG. 11.

FIG. 13 is a perspective view, similar to FIG. 12 showing a variant of the invention.

DETAILED DESCRIPTION

Figure 1:
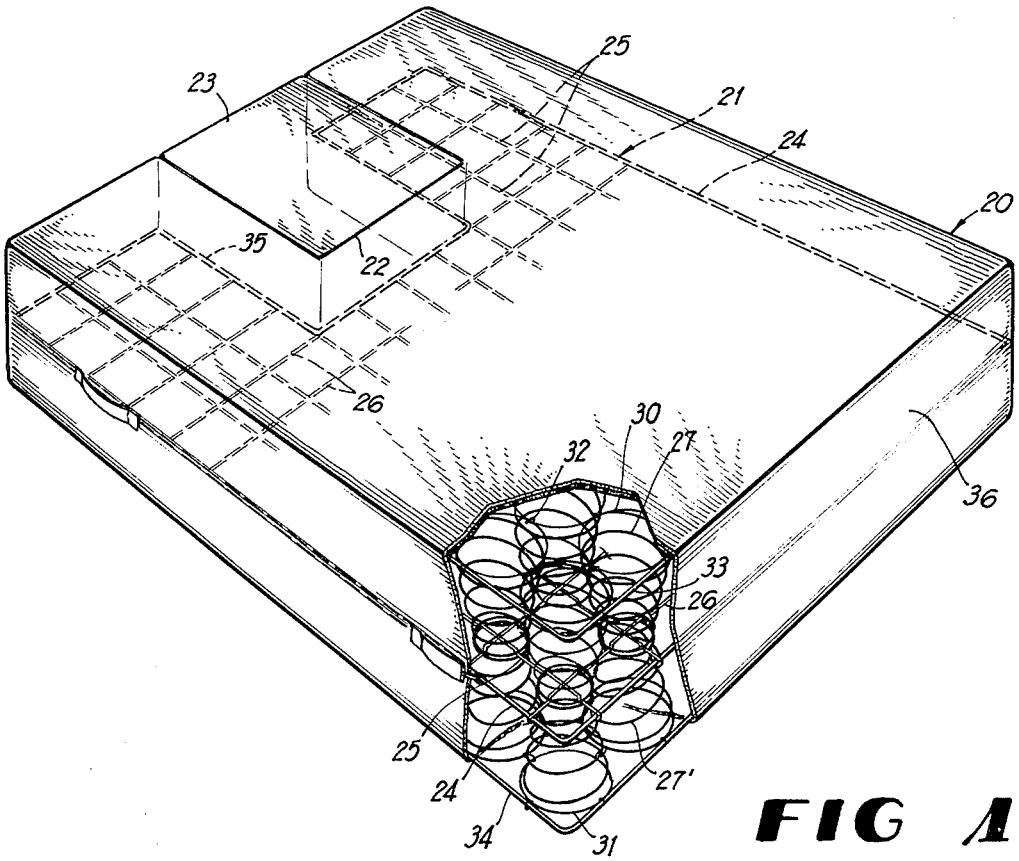
FIG. 1 is a perspective view, partly broken away, of a mattress embodying the present invention according to one preferred embodiment.

Referring to the drawings in detail wherein like numerals designate like parts and referring first to FIGS. 1 through 5, the numeral 20 designates a unitary bed mattress constructed in accordance with the invention which obviates the necessity for using a separate box spring and which, in essence, provides its own built in box spring portion below a median plane stiff wire reinforcing grid 21 of the mattress, to be further described, and forming a very important aspect of the invention.

As shown in FIG. 1, the mattress 20 may have a rectangular notch or recess 22 provided in one end thereof containing a removable or adjustable auxiliary mattress section 23 of the kind disclosed in prior U.S. Pat. No. 3,991,428 and for the purpose set forth therein. The invention is also applicable to mattresses which do not possess the recess 22 or insert auxiliary mattress 23.

The wire reinforcing grid 21 may have its rigidity predetermined to meet particular loading requirements by proper wire size selection. Preferably, the grid 21 is fabricated by welding and spans the entire rectangular area of the mattress at or near the median horizontal plane thereof. A typical high profile mattress according to the invention may be 12–14 inches thick although this dimension may vary somewhat and is not critical. The mattress can be constructed in all commercial sizes including single, standard double, queen and king size.

The aforementioned reinforcing grid 21 comprises a main rectangular marginal frame 24 of comparatively heavy wire and a multiplicity of right angular crossing equidistantly spaced grid wires 25 and 26, as illustrated. The welded reinforcing grid 21 is of unitary construction in its completed state.

Figure 2:
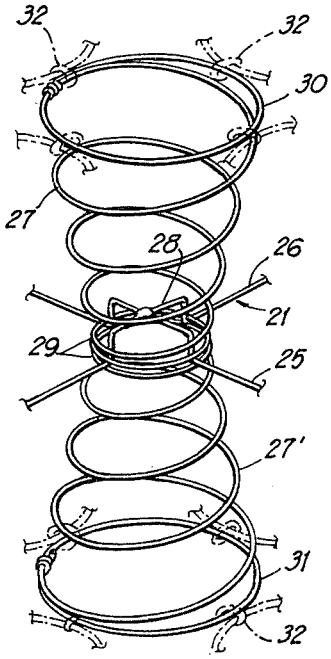
FIG. 2 is an enlarged perspective view showing a connection between a mattress reinforcing grid and associated coil springs according to FIG. 1.

The grid 21 is employed in the mattress with a multiplicity of coacting upper and lower preferably conical coil compression springs 27 and 27', FIG. 2, which may be fabricated from a single wire section to provide, in effect, a single spring composed of the downwardly and upwardly tapering sections 27 and 27'. One such spring arrangement can be employed at each welded intersection of the grid wires 25 and 26, and each such intersection may be humped upwardly or downwardly from the main plane of the grid 21 as clearly illustrated at 28 in FIG. 2. The center reduced diameter coils 29 of spring 27—27′ can be engaged over each hump 28 of the wire grid 21 to anchor each spring thereto.

The top and bottom enlarged coils 30 and 31 of each spring 27—27′ are further anchored and stabilized by lashing them to adjacent springs as at 32 and by similarly lashing the coils 30 and 31 to top and bottom main marginal continuous wire frames 33 and 34, FIG. 1, at the top and bottom of the rectangular mattress.

It can be seen that in FIG. 1 that, when the recess 22 and adjustable auxiliary mattress section 23 are employed, the median plane reinforcing grid 21 has its marginal frame 24 directed around the recess 22 in a U-configuration, as indicated by the numeral 35. When the elements 22 and 23 are not present, the grid frame portion 35 is omitted and the grid is completely rectangular, spanning the length and width of the mattress 20.

The mattress 20 is provided with any desired type of casing or envelope 36 formed of flexible material. The details of the casing 36 will vary with styling the quality requirements, as is well known in the art. The grid 21 is equidistantly spaced from and parallel to the top and bottom frames 33 and 34.

Figure 5:
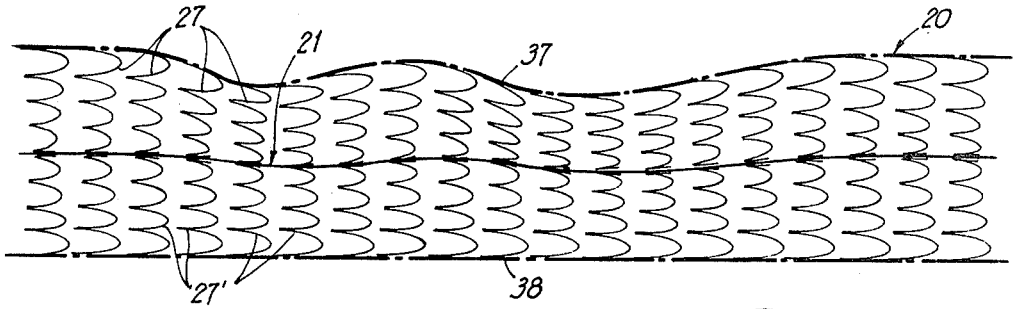
FIG. 5 is a diagrammatic view graphically illustrating the action of the mattress reinforcing grid in FIGS. 1 to 4.

Diagrammatic FIG. 5 illustrates the functional improved results obtained from the use of the median plane reinforcing grid 21. As shown therein, the top surface of the mattress beneath which the upper spring sections 27 are situated can yield and become contoured as at 37 to conform to the body curvature of a user. The reinforcing grid 21 yields slightly but to a much lesser degree than the top of the mattress, FIG. 5, and the bottom surface 38 of the mattress will remain virtually flat. The net effect of this is that the use of the grid 21 in conjunction with the upper and lower spring sections 27 and 27′ produces a composite mattress structure whose upper section above the grid 21 is quite yieldable in the interest of comfort while the lower section beneath the grid 21 functions in the manner of a box spring while in fact no actual box spring is required under the mattress, as explained. Additionally, the grid 21 greatly enhances the durability and the useful life of the mattress by resisting sagging and local permanently deformation under usage.

Figure 3:
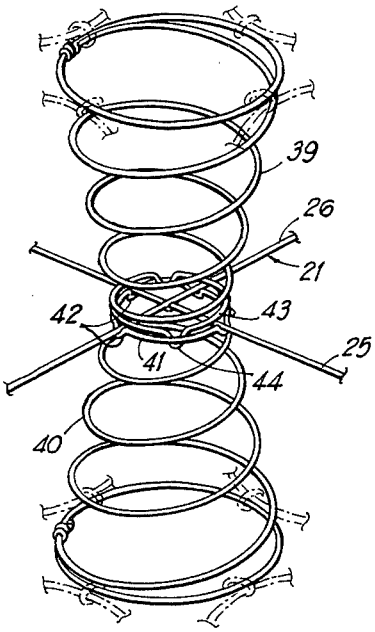
FIG. 3 is a similar perspective view showing a variant of the arrangement shown in FIGS. 1 and 2.

FIG. 3 shows a variant of the invention in which the upper and lower springs 39 and 40 are separately formed and not unitary as in the case of springs 27—27′. The construction of the grid 21 is unchanged in FIG. 3. The top coil 41 of each lower spring 40 has grid wire receiving the seating formations 42 formed therein while the lower coil 43 of each upper spring 39 has similar spaced formations 44 which enter the coil 41 and are centered thereby.

Figure 4:
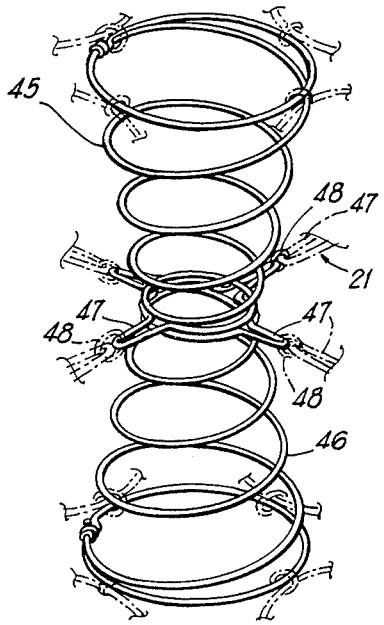
FIG. 4 is a similar perspective view showing another variant.

FIG. 4 shows still another variant of the spring and grid connection arrangement in which each upper and lower spring 45 and 46 is equipped with radial loops 47 adapted to be lashed by small rings 48 to the loops 47 of adjacent springs. Other variations in the connecting means for the springs and reinforcing grid 21 may be resorted to.

Figure 6:
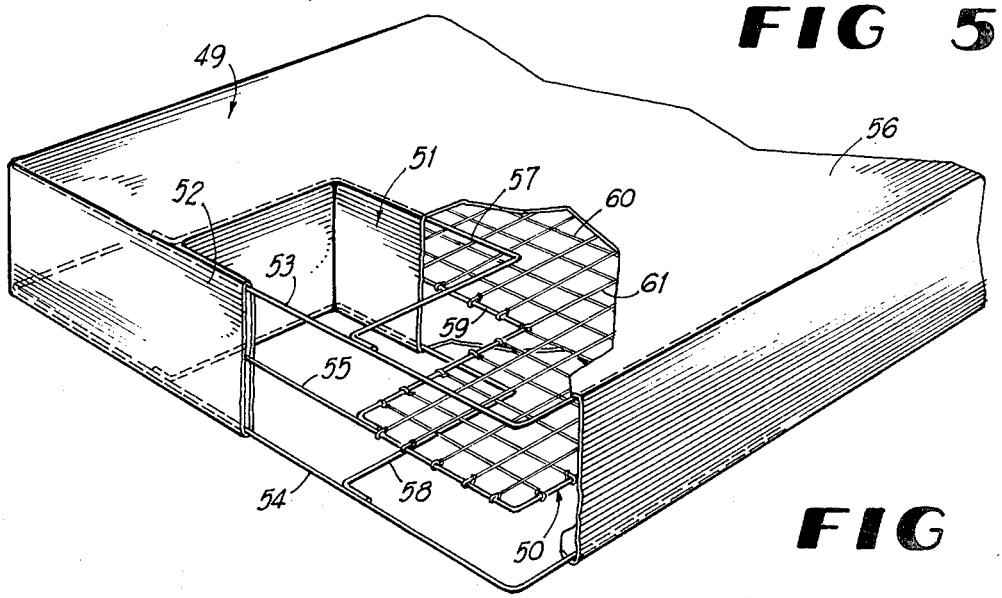
FIG. 6 is a fragmentary perspective view showing a modification of the mattress in FIG. 1, with parts omitted.

FIG. 6 shows a modification of the invention in FIG. 1 where the coil springs are omitted for clarity of illustration but are present in actuality. The modified mattress 49 in FIG. 6 has a median plane reinforcing grid 50 constructed essentially as described in the prior embodiment. A recess 51 corresponding to the recess 22 is provided in one end of the mattress 49 and instead of this recess being open through the adjacent end of the mattress it is closed by a full height partition 52 formed by one side 53 of the top mattress marginal frame, a corresponding side 54 of the bottom marginal frame, and a parallel intermediate bar or wire section 55 lying in the plane of the grid 50 and forming an integral part of the reinforcing grid. The three elements 53, 54 and 55 of the partition 52 are in a common vertical plane and are covered with the fabric material utilized for the mattress envelope 56, as illustrated.

The opposite side and rear wall portions of the recess 51 are framed by top and bottom U-frames 57 and 58 anchored to the top and bottom marginal frames of the mattress and being in common planes therewith. Similarly, the grid 50 is equipped with an integral U-frame 59 of the same size and parallel to the U-frames 57 and 58 and being connected to the grid wires 60 and 61, as illustrated in FIG. 6. Except for these details of construction, the invention in FIG. 6 is identical to that described in FIGS. 1 to 5.

Figure 7:
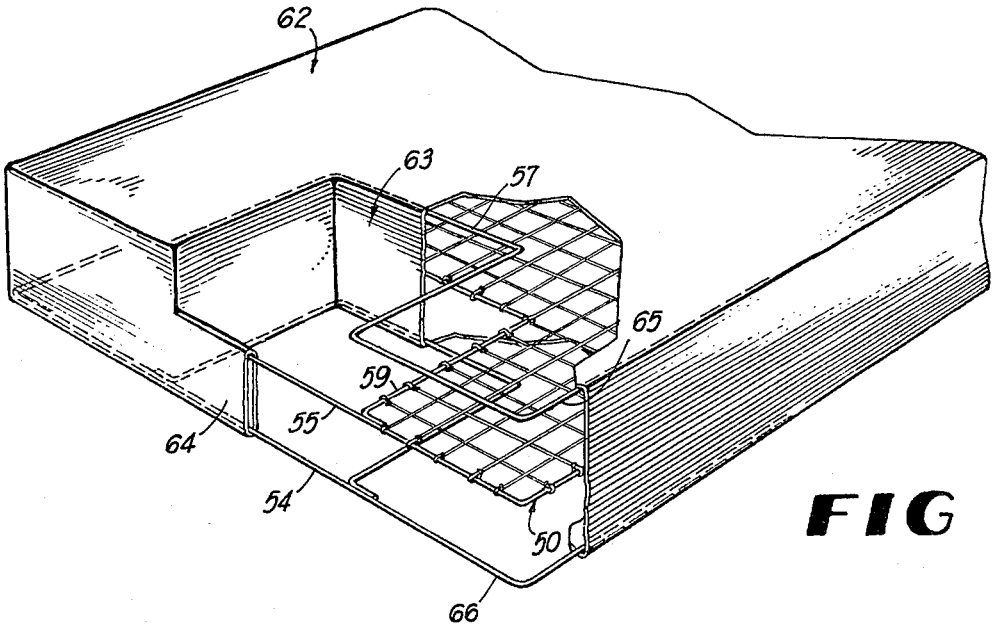
FIG. 7 is a similar view showing a further modification.

FIG. 7 shows a further modification in which the mattress 62 is constructed substantially in accordance with FIG. 6 except for the fact that the recess 63 in one end of the mattress is closed by a mattress half-height or half-thickness panel 64 instead of the full height panel 52 of FIG. 6. The upper member 53 shown in FIG. 6 is omitted from the construction shown in FIG. 7 but the lower member 54 and intermediate member 55 are utilized. The upper U-frame 57 is integrated with the top mattress marginal frame 65 and the bottom U-frame 58 is secured to the bottom marginal frame 66. The intermediate U-frame 59 provided in the grid 50 is constructed in the same manner as shown in FIG. 6 and is joined to the member 55. Again, the only difference in the two constructions is the fact that the recess closure panel 64 is half-height rather than full height.

Figure 8:
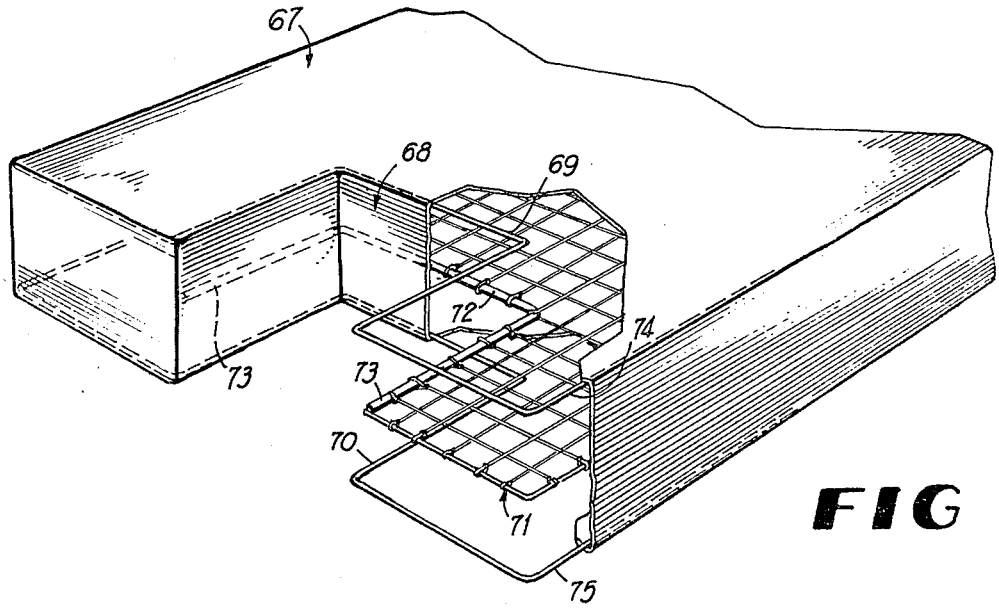
FIG. 8 is a similar view showing a still further modification.

FIG. 8 shows another modification in which a mattress 67 has an open recess 68 for the purpose described and framed at its top by a U-frame 69 forming a part of the top marginal frame of the mattress and at its bottom by a U-frame 70 forming a part of the bottom marginal frame of the mattress. A median plane reinforcing grid 71 is utilized for the purposes already described and constructed in accordance with the previous detailed descriptions for the grids 21 and 50. The modified feature in FIG. 8 is that the U-frame 72 for the recess 68 embodied in the grid 71 is of increased thickness and rigidity to prevent excessive deformation of the mattress.

Figure 9:
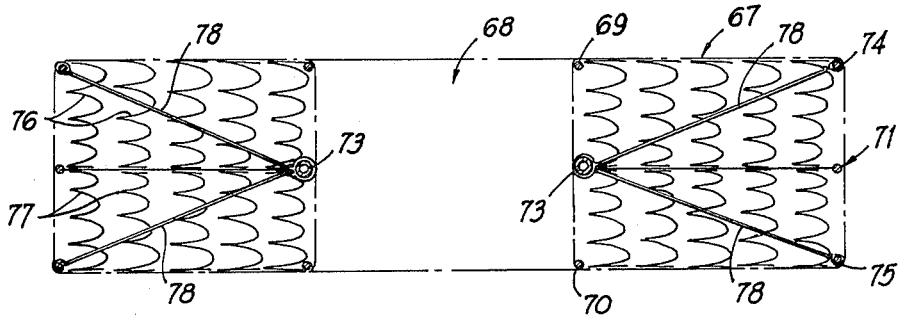
FIG. 9 is a partly diagrammatic transverse vertical cross section through the mattress illustrated in FIG. 8.

FIG. 9 illustrates the mattress 67 in FIG. 8 and shows the side sections 73 of the increased thickness U-frame 72 which may be formed by tubing placed over the wire used for the median plane grid 71. The top and bottom marginal frames of the mattress are shown at 74 and 75 in FIGS. 8 and 9 and the top and bottom coil springs are shown at 76 and 77 schematically and are connected with the grid 71 and frames 74 and 75 and with each other in any of the ways shown and described in FIGS. 2, 3 and 4.

To further strengthen the mattress to resist sagging and other permanent deformation, any desired number of sets of inclined converging tie wires 78 may be connected between the top and bottom marginal frames 74 and 75 and the side sections 73 of the increased thickness U-frame 72 for the recess 68. With the tie wires 78 present, the parallel U-frame sides 73 become very resistant to bending or deformation as can be readily understood.

FIG. 10 shows a further modification of the invention in which a mattress 79 has a body portion formed of foam elastomer which body portion is molded around a median plane wire reinforcing grid 80 constructed substantially like the grid 71 in FIG. 8 including the U-frame 81 of increased strength and rigidity and following the margin of an end recess 82 molded into the mattress 79. The wire grid 80 is totally embedded and enclosed in the elastomeric material utilized in the mattress 79 and serves essentially the same purpose already described for strengthening and increasing the overall durability of the mattress. The coil springs of the prior embodiments are not included in FIG. 10 and are not needed because of the cushioning action of the thick layers of elastomer foam in the mattress body portions above and below the embedded grid 80. The mattress in FIG. 10 can also be made without the recess 82 and without the U-frame 81, in which case the mattress and grid are rectangular and the grid spans the total rectangular area of the mattress.

FIG. 11 shows another modified version of the invention in which an elastomer mattress 79' with embedded reinforcing grid 80' are constructed exactly as described in connection with FIG. 10, except that the increased thickness U-frame 81 in FIG. 10 is not utilized. Instead, the regular framing wire for the median plane grid 80' passes around the recess 82 when such recess is provided in the mattress.

FIG. 12 shows an additional modification of the invention in which an elastomer mattress 179 with embedded reinforcing grid (not shown) are constructed exactly as described with FIG. 11, with the addition of a flat resilient elastomer panel section 185 bonded to the end of mattress 179 and vertically spanning the recess 182 therein.

If desired, the panel section 185 may be a rigid flat rectangular plate which is formed of wood, plastic or metal, padded along its exposed surfaces and is secured by its end portions being embedded in the opposed side portions of the mattress 174 which define the cavity, so that the outer surface of the panel section 185 is coplanar with the end of the mattress 179 and can receive the appropriate sheets and covering. The function of the panel section 185 is to prevent appreciable widening of cavity 182 and thereby preserve the rectangular shape and appearance of mattress 174. Thus, the panel section 185 is suitable whether mattress 174 is of conventional interior construction or has reinforcing, such as the grid 80.

FIG. 13 shows a modified version of the invention in which an elastomer mattress 279 with embedded reinforcing grid (not shown) are constructed exactly as described in FIG. 12, except that the flat resilient elastomer panel section is not utilized. Instead, an end wire 287 is molded into the end portions of the mattress 279 intermediately between the top and bottom surfaces of said mattress and spans the recess 282 therein. The advantage of either the end wire 287 or the flat resilient elastomer panel 185 is in enabling the all elastomer mattress to retain its shape about the recess.

In all disclosed embodiments of the invention, the provision of a median plane reinforcing wire grid adds greatly to the durability and useful life span of the mattress. In the embodiments where inner coil springs are utilized with the reinforcing grid, the unitary mattress structure thus produced has the functional capabilities of the customary inner spring mattress plus a separate underlying box spring unit, but without the added expense.

It is to be understood that the forms of the invention herewith shown and described are to be taken as preferred examples of the same and that various changes in the shape, size and arrangement of the parts may be resorted to, without departing from the spirit of the invention or scope of the subjoined claims.

I claim:

1. A bed mattress comprising a body portion of substantially uniform thickness, a median plane wire reinforcing grid for the mattress spanning substantially the entire area of the mattress and having a marginal frame and a multiplicity of crossing straight grid wires attached to said frame, and cushioning means included in said body portion above and below the median plane reinforcing grid and spanning substantially the entire area of the mattress, said cushioning means having marginal portions substantially above and below the marginal frame of said grid.

2. A bed mattress as defined in claim 1, and said mattress having a recess formed through one end thereof, said recess being of such dimensions that the kneeling body of a person may be received therein.

3. A bed mattress as defined in claim 2, and an auxiliary mattress section adapted to occupy said recess.

4. A bed mattress as defined in claim 2, and the marginal frame of said wire grid being formed to extend around the margin of said recess.

5. A bed mattress as defined in claim 1, and said cushioning means comprising a bank of coil springs above and below said reinforcing grid and attached to the grid.

6. A bed mattress as defined in claim 1, and said mattress body portion being unitary and being formed of an elastomer, said wire reinforcing grid being bodily enclosed in the elastomer, and said cushioning means comprising substantially equal thickness layers of elastomer above and below said wire reinforcing grid.

7. A bed mattress as defined in claim 6, and said mattress having a recess formed through one end thereof and through the adjacent end of the wire reinforcing grid.

8. A bed mattress as defined in claim 5, and an envelope of flexible sheet material for said mattress enclosing said wire reinforcing grid and coil springs.

9. A bed mattress as defined in claim 5, and said wire grid having humps formed in said grid wires at their crossing points and said humps being received within coils of said springs near said median plane.

10. A bed mattress as defined in claim 1, and said grid wires being connected at their crossing points in said grid.

11. A bed mattress of substantially uniform thickness and having a functional recess formed through one end thereof, a substantially median plane wire reinforcing grid for said mattress and spanning substantially the entire area of the mattress and being formed to extend around the margin of said recess, and comparatively thick cushioning zones in said mattress between the top and bottom faces thereof and on opposite sides of said wire reinforcing grid.

12. A bed mattress as defined in claim 6, and a resilient elastomer panel section bonded to the end portions of said mattress which border said recess wherein said panel section vertically spans said recess.

13. A bed mattress as defined in claim 6, and an end wire molded into the end portions of said mattress which border said recess wherein said end wire spans said recess.

14. A mattress comprising a rectangular mattress body provided with a rectangular outwardly opening recess in one end thereof, said body having spaced end portions which define the cavity therebetween, and a means extending between and joining the ends of said end portions for closing the open end of said cavity for arresting appreciable widening of said cavity.

15. The bed mattress defined in claim 14 wherein said means is a flat rectangular panel.

16. The bed mattress defined in claim 14 wherein said means is a rod.

17. The bed mattress defined in claim 15 wherein said panel is a rigid member padded along its exposed surfaces.

18. A bed mattress comprising a body portion of substantially uniform thickness, a median plane wire reinforcing grid for the mattress spanning substantially the entire area of the mattress and having a marginal frame and a multiplicity of crossing grid wires attached to said frame, and cushioning means included in said body portion above and below the median plane reinforcing grid and spanning substantially the entire area of the mattress, mattress having a recess formed through one end thereof, the marginal frame of said wire grid being formed to extend around the margin of said recess, and the portion of said marginal frame extending around the margin of said recess being of thicker and more rigid construction than the remainder of the marginal frame of said wire grid.

19. A bed mattress comprising a body portion of substantially uniform thickness, a median plane wire reinforcing grid for the mattress spanning substantially the entire area of the mattress and having a marginal frame and a multiplicity of crossing grid wires attached to said frame, and cushioning means included in said body portion above and below the median plane reinforcing grid and spanning substantially the entire area of the mattress, the mattress body portion being unitary and being formed of an elastomer, said wire reinforcing grid being bodily enclosed in the elastomer, and said cushioning means comprising substantially equal thickness layers of elastomer above and below said wire reinforcing grid, and the recessed portion of the wire grid having a marginal frame around the recess which is thicker and more rigid than the remainder of the wire grid.

20. A bed mattress comprising a body portion of substantially uniform thickness, a median plane wire reinforcing grid for the mattress spanning substantially the entire area of the mattress and having a marginal frame and a multiplicity of crossing grid wires attached to said frame, and cushioning means included in said body portion above and below the median plane reinforcing grid and spanning substantially the entire area of the mattress, said cushioning means comprising a bank of coil springs above and below said reinforcing grid and attached to the grid, and the coil springs in the banks above and below said reinforcing grid being separately formed springs and having their interior end coils near said median plane mechanically shaped to interlock with the crossing grid wires for anchoring the coil springs thereto in the mattress.

21. A bed mattress comprising a body portion of substantially uniform thickness, a median plane wire reinforcing grid for the mattress spanning substantially the entire area of the mattress and having a marginal frame and a multiplicity of crossing grid wires attached to said frame, and cushioning means included in said body portion above and below the median plane reinforcing grid and spanning substantially the entire area of the mattress, said mattress having a recess formed through one end thereof, said recess having a thin full height closure partition at the outer side thereof defined by top and bottom marginal frames of the mattress and a median plane frame member of said grid.

22. A bed mattress comprising a body portion of substantially uniform thickness, a median plane wire reinforcing grid for the mattress spanning substantially the entire area of the mattress and having a marginal frame and a multiplicity of crossing grid wires attached to said frame, and cushioning means included in said body portion above and below the median plane reinforcing grid and spanning substantially the entire area of the mattress, said mattress having a recess formed through one end thereof, said recess having a half-height closure partition at the outer side thereof defined by a bottom marginal frame of the mattress and a median plane member of said grid.

* * * * *